US005172553A

United States Patent [19]

Barton et al.

[11] Patent Number: 5,172,553

[45] Date of Patent: Dec. 22, 1992

[54] CONVECTIVE, TEMPERATURE-EQUALIZING SYSTEM FOR MINIMIZING COVER-TO-BASE TURBINE CASING TEMPERATURE DIFFERENTIALS

[75] Inventors: Serge P. Barton, Oviedo; Peter G. Smith, Winter Park, both of Fla.

[73] Assignee: Westinghouse Electric Corp., Pittsburgh, Pa.

[21] Appl. No.: 823,420

[22] Filed: Jan. 21, 1992

[51] Int. Cl.[5] ..... F01K 13/02

[52] U.S. Cl. ..... 60/656; 60/646; 60/657

[58] Field of Search ..... 60/646, 656, 657

[56] References Cited

U.S. PATENT DOCUMENTS

| | | | |
|---|---|---|---|
| 4,226,086 | 10/1980 | Binstock et al. | 60/656 |
| 4,282,708 | 8/1981 | Kuribayashi et al. | 60/39.02 |
| 4,584,836 | 4/1986 | McClelland | 60/646 |
| 4,598,551 | 7/1986 | Dimitroff, Jr. et al. | 60/646 |
| 4,651,532 | 3/1987 | Abe | 60/646 |
| 4,679,399 | 7/1987 | Strickler | 60/646 |

*Primary Examiner*—Allen M. Ostrager

[57] ABSTRACT

A method and apparatus wherein, during time periods when a turbine is off-line and in a restart-ready condition, residual steam is circulated in the turbine between the cover and base of the turbine such that the cover and base are maintained at generally equal temperatures.

9 Claims, 1 Drawing Sheet

CONVECTIVE, TEMPERATURE-EQUALIZING SYSTEM FOR MINIMIZING COVER-TO-BASE TURBINE CASING TEMPERATURE DIFFERENTIALS

This invention relates to steam turbines and, more particularly, to a method and apparatus for maintaining a generally uniform temperature of a turbine casing during a shut-down.

BACKGROUND OF THE INVENTION

Steam turbines are generally designed to operate at relatively uniform cover-to-base temperatures and the clearances within such turbines for various seals and bearings are established for operation of the turbine at such uniform temperatures. Although the turbines experience variable temperatures during start-ups and shut-downs, so long as the temperature over the extent of the turbine is maintained at a relatively uniform cover-to-base values, the turbine can accommodate such temperature variations. However, if the temperature between the upper half of a turbine varies significantly from temperatures within the lower half of the turbine at the same axial location, distortion of the turbine may occur and result in damage due to contact between rotating components within the turbine system. Such temperature variations are generally more predominate during turbine shut-down when active steam flow has been terminated into the turbine. In a shut-down mode, the turbine experiences a cooling of the casing and other metal parts. Normally, the turbine rotor is maintained in rotation at a relatively low speed using an external drive in order to prevent sagging or deformation of the rotor if it were allowed to come to a full rest. The casing surrounding the turbine may be subjected to differential temperatures for various reasons including simply that the higher temperature residual steam-air mixture within the turbine at shut-down may rise to the top of the turbine casing while the cooler steam-air mixture may settle to the bottom. In addition, various steam extraction lines connected to the turbine may experience a reverse flow as the pressure relationships among the turbine casings, piping systems and connected pressure vessels change after steam flow has been terminated, and cooling of the various components takes place at different rates. The cooling of the varying sub-atmospheric pressures not encountered during active turbine operation may cause the steam or water mixtures within the extraction lines to back-up into the turbine casing and increase the rate of cooling of the casing. The major effect of such cooling may cause the upper portion of the casing, hereinafter referred to as the cover, to be at a different, usually higher temperature than the lower portion of the casing, hereinafter referred to as the base. Since the turbine casing is essentially an elongated housing, the effect of a temperature differential between the cover and the base is to cause the casing to attempt to bend or arc. Such casing deformation may result in contact between rotating components on the rotor and various elements attached to the casing. Any such contact may contribute to internal damage requiring maintenance before the turbine can be restarted.

U.S. Pat. No. 4,584,836 describes one solution to the problem of unequal cooling of turbine casings. As described therein, one solution to controlling the temperature variation of the turbine casing is to cover the casing with what is essentially an electric blanket. The disclosed system monitors the temperature of the casing and adjusts power applied to various sections of the electric blanket covering the casing in order to maintain essentially uniform temperature of the casing over the extent of the turbine. While the use of the electric blanket is satisfactory for maintaining turbine casing temperature, this particular solution is relatively expensive and, in addition, requires that a blanket having electrical wiring be positioned about a thermally conductive surface. Furthermore, this system requires electric power in order to operate the electric blankets and as such consumes relatively large amounts of energy. Accordingly, it would be desirable to provide a method and apparatus for maintaining casing temperature equilibrium without the use of expensive, specially designed electric blankets.

SUMMARY OF THE INVENTION

The present invention is directed to a method and apparatus which overcomes the above and other disadvantages of prior art systems for maintaining temperature equilibrium of turbine casings. In an illustrative embodiment, the present invention provides a system for maintaining generally uniform temperature of a steam turbine during time periods when the turbine is off-line and in a restart-ready condition. The disclosed system includes means for circulating residual steam in the turbine between the cover and base of the turbine such that the cover and base are maintained at generally equal temperatures. In one form, the system employs an upper manifold connected to the cover and a lower manifold connected to the base. The manifolds are coupled together through a blower system which is capable of pulling the steam-air mixture from the upper casing portion or cover and blowing it into the lower casing portion or base so that the circulating steam-air mixture maintains the generally uniform temperature of the cover and base. Temperature sensors are connected to both the cover and base of the steam turbine with their outputs being connected to a control system which is capable of energizing the blower whenever the temperature difference between the cover and base exceeds a preselected value. Typically such a value might be 75° F. Both the upper and lower manifolds include valves operable from the control system to close-off this bypass path around the turbine casing during normal operation of the steam turbine. Further, the system may include pressure sensing means for monitoring the pressure within the steam turbine and for inhibiting operation of the valves and blower whenever the pressure within the turbine is greater than a preselected value. The blower system may also include a drain line which can be opened when the blower is in a non-operative position, for example, and the valves in each manifold are closed in order to drain the residual fluid from the blower system while the turbine is in a operating state.

BRIEF DESCRIPTION OF THE DRAWING

For a better understanding of the present invention, reference may be had to the following detailed description taken in conjunction with the accompanying drawing in which.

DETAILED DESCRIPTION OF THE PRESENT INVENTION

Figure 1:
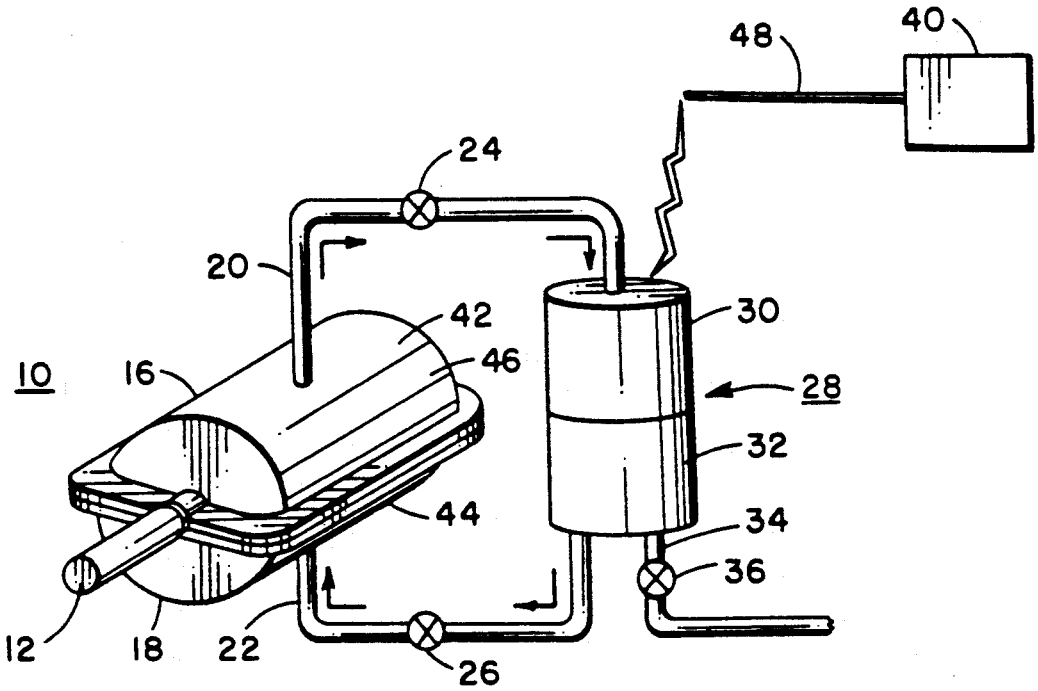
FIG. 1 is a simplified functional block diagram of a turbine temperature equalizing system in accordance with the present invention.

Turning now to the single figure, there is shown a representation of a steam turbine 10 having a rotor shaft 12 extending through an outer cylinder casing 14. The outer casing comprises an upper portion or cover 16 and a lower portion or base 18. External piping manifold 20 connects to the cover 16 and external piping manifold 22 connects to the base 18. Each of the manifolds 20 and 22 include respective isolation valves 24 and 26. Each of the manifolds further feed into a blower assembly 28 which includes a drive motor 30 and blower housing 32. Operation of the drive motor 30 effects operation of the blower within the blower housing 32 to draw the steam-air mixture from either the cover or base and force it into the other of the cover and base. Optionally, the blower can be run in either a forward or a reverse direction in order to move the steam-air mixture from the cover to the base or from the base to the cover. A pipe 34 connects to the blower and includes a drain valve 36 to allow accumulated moisture within the blower to be drained from the blower, for example, when the isolation valves and the two manifolds are closed and the turbine is in an on-line condition.

A system controller 40 is coupled to the drive motor 30 and is effective to energize the drive motor 30 in response to temperature and pressure signals obtained from within the turbine 10. One or more first temperature sensors indicated generally at 42 are mounted in the inner casing cover and one or more temperature sensors 44 are located in the inner casing base. Each of these temperature sensors provides an input to the system controller 40. In addition, a pressure sensor indicated generally at 46 may be coupled to the turbine casing for monitoring the internal steam-air mixture.

The system controller 40 may be a controller of the type described in U.S. Pat. No. 4,226,086 issued Oct. 7, 1980 and assigned to the assignee of the present invention. Such a system controller includes a microprocessor capable of monitoring a multiple number of inputs including temperature and pressure inputs and providing output signals in response thereto.

In operation, when the turbine is in a shut-down condition, a signal is supplied to the system controller via line 48 indicating that the turbine is in the shut-down mode. This signal allows the system controller to begin monitoring the pressure and temperature signals from the turbine. Once the pressure has dropped to below a preselected value, the controller then determines whether the differential temperature between the casing and base exceeds another preselected value, such as, for example, 75° F. If the differential temperature exceeds the preselected value, the controller opens the isolation valves in the two manifolds and energizes the drive motor 30 to effect circulation of the residual steam-air mixture within the turbine inner casing. By circulating this residual steam-air mixture, the temperature through the steam turbine can be made more generally uniform. The warmer steam, which is often found at the top of the turbine casing, is circulated to the bottom or base of the turbine casing so that there is no accumulation of cooler steam-air mixture in the lower part of the casing. Obviously, the circulation could be effected in the opposite direction if, for some reason, this was desired, for example, to differentially affect the heat transfer rates of the accumulated steam, water, or air mixture in the lower portion of the turbine relative to the upper portion of the turbine. At turbine restart, the system controller closes the isolation valves, isolating it from the hot, high pressure steam, and limiting the steam conditions acting on the motor blower assembly to a low pressure, low temperature typical of the drain valve and causing the condensation accumulated in the blower system to drain off. The pressure sensor could be made an optional feature to assure that the isolation valves are only opened and the blower motor energized when the turbine is on turning gear and when the internal pressure is within acceptable sub-atmospheric range. Such a pressure range would be higher than a hard vacuum but less than atmospheric pressure.

The disclosed system provides a method for equalizing temperature within a turbine inner casing through addition of only a small amount of external piping and manifold assembly with isolation valves and a motor driven blower. The disclosed system uses the process of forced convection to circulate residual heat within the turbine to equalize casing temperatures and prevent restart delays characteristic of prior art systems. This system automatically engages when predetermined temperature differentials develop between the casing cover and base during periods when active steam flow is not entering the turbine. This system is typically set to operate only when the internal pressure within the turbine is within an acceptable range and is inhibited from operation when the turbine is in its normal operating condition.

The system prevents the normal restart delays caused by inner casing cover-to-base temperature differentials, minimizes turbine degradation from interference such as rubbing and seal damage caused by distortion of the turbine casing, and prevents reduction in turbine output while reducing maintenance requirements caused by seal damage.

What has been described is a simplified system for reducing the time required for restart of a steam turbine after shut-down by maintaining equilibrium temperature within the turbine casing. While the invention has been described in what is presently considered to be a preferred embodiment, other modifications and variations will become apparent to those skilled in the art. It is intended therefore that the invention not be limited to the illustrative embodiment but be interpreted within the full spirit and scope of the following claims.

What is claimed is:

1. A system for maintaining generally uniform temperature of a steam turbine during time periods when the turbine is off-line after a period of operation, the system including means for circulating residual steam-air mixture in the turbine between an upper portion of a casing of the turbine and a lower portion of the casing for generally equalizing temperatures at the upper and lower portions of the casing and means inhibiting operation of said circulating means when pressure within said turbine exceeds a preselected value.

2. The system of claim 1 wherein said circulating means comprises a first manifold coupled to said upper portion of said casing, a second manifold connected to said lower portion of said casing, and a blower assembly coupled between said first and second manifolds for selectively circulating the steam-air mixture between said upper and lower portions through said manifolds.

3. The system of claim 2 and including valve means in each of said manifolds for blocking steam flow therethrough during turbine operation.

4. The system of claim 3 and including a control system for controlling operation of said blower assembly, said control system effecting energization of said blower assembly when a temperature difference between said upper and lower portions of said casing exceeds a preselected value.

5. The system of claim 4 wherein said control system includes means for controlling operation of said valve means and for inhibiting opening of said valve means when said difference between said temperature and said pressure exceeds said respective preselected values.

6. A method for minimizing temperature difference between an upper casing cover and a lower casing base of a steam turbine after shut-down to prevent casing distortion, the method comprising the steps of:

sensing shut-down of the steam turbine; and circulating residual steam within the turbine casing between the cover and the base.

7. The method of claim 6 and including the further step of sensing temperature of the cover and the base and effecting the circulating step only when a temperature difference between the cover and the base exceeds a preselected value.

8. The method of claim 7 wherein a first manifold is coupled to the cover and a second manifold is coupled to the base, the circulating step including the step of circulating residual steam through the first and second manifolds.

9. The method of claim 8 and including the further step of sensing pressure within the turbine and effecting said step of circulating only when said sensed pressure is less than a preselected value.

* * * * *